US008421734B2

(12) United States Patent
Wang

(10) Patent No.: US 8,421,734 B2
(45) Date of Patent: Apr. 16, 2013

(54) DRIVING METHOD AND APPARATUS OF LCD PANEL, AND ASSOCIATED TIMING CONTROLLER

(75) Inventor: Shih-Chung Wang, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 930 days.

(21) Appl. No.: 12/504,978

(22) Filed: Jul. 17, 2009

(65) Prior Publication Data

US 2010/0171688 A1 Jul. 8, 2010

(30) Foreign Application Priority Data

Jan. 6, 2009 (TW) ..... 98100155 A

(51) Int. Cl.
*G09G 3/36* (2006.01)

(52) U.S. Cl.
USPC ..... 345/99; 345/98; 345/94; 345/96; 345/102; 345/211; 345/690; 345/204

(58) Field of Classification Search ..... 345/690, 345/87–100, 204, 211
See application file for complete search history.

(56) References Cited

U.S. PATENT DOCUMENTS

| | | | | |
|---|---|---|---|---|
| 8,077,135 | B2 * | 12/2011 | Hsu et al. | 345/100 |
| 2005/0237294 | A1 * | 10/2005 | Miyachi | 345/102 |
| 2008/0238854 | A1 * | 10/2008 | Kimura | 345/98 |
| 2009/0225104 | A1 * | 9/2009 | Hu et al. | 345/690 |

* cited by examiner

*Primary Examiner* — Lun-Yi Lao
*Assistant Examiner* — Olga Merkoulova
(74) *Attorney, Agent, or Firm* — Edell, Shapiro & Finnan, LLC

(57) ABSTRACT

A timing controller of an LCD panel is provided. The timing controller, for controlling a plurality of source drivers and a plurality of gate drivers of the LCD panel, includes a data processing module for generating a data signal carrying image data and black data, and a control signal generating module for generating a plurality of horizontal start signals, a first gate enable signal and a second gate enable signal. The horizontal start signals are for controlling the inputting of the data signals into the source drivers. The first and second gate enable signals correspond to different enable timings, and are selectively outputted to the gate drivers.

20 Claims, 12 Drawing Sheets

"PRIOR ART"

DRIVING METHOD AND APPARATUS OF LCD PANEL, AND ASSOCIATED TIMING CONTROLLER

CROSS REFERENCE TO RELATED PATENT APPLICATION

This patent application is based on Taiwan, R.O.C. patent application No. 098100155 filed on Jan. 6, 2009.

FIELD OF THE INVENTION

The present invention relates to a solution for motion image blur of a hold-type display device, and more particularly, to a driving method and apparatus of an LCD panel, and an associated timing controller.

BACKGROUND OF THE INVENTION

Motion image blur of a hold-type display device, such as an active matrix liquid crystal display (AMLCD), is a widely discussed issue. Reasons that result in motion image blur include slow liquid crystal response time, capacitance variance in pixels, and so-called "sample-and-hold artifact".

According to the prior art, the first two reasons that lead to motion image blur are overcome using voltage overdrive. However, the last reason, being an outcome from a combination of sampling characteristics of the AMLCD and smooth motion tracking characteristics of a user's perception mechanism, is extremely difficult to solve and thus still persists in LCDs on the market since the prior art does not provide a satisfactory solution to the sample-and-hold artifact. For example, in a prior solution, data of an entire image is intermittently replaced by full-black image data to disturb the sense of continuity in visual perception to further weaken the effect of sample-and-hold artifact. However, this solution causes the brightness of the image to appear dark.

Further, solutions of the prior art generally require rather complex control mechanisms and high cost in research and development as well as manufacturing, all of which add unfavorable factors to products to be sold on the market.

SUMMARY OF THE INVENTION

Therefore, it is an objective of the invention to provide an LCD driving method and apparatus, and an associated timing controller for overcoming the issue of motion image blur of a hold-type display device.

It is another objective of the invention to provide an LCD driving method and apparatus, and an associated timing controller for handling sample-and-hold artifact of a displayed image of a display device.

According to one preferred embodiment of the invention, a driving method for an LCD panel with a driving apparatus comprising a plurality of source drivers is provided. The driving method comprises generating a data signal for carrying image data and black data; providing a plurality of horizontal start signals, each of which having a first pulse signal and a second pulse signal; loading the image data in sequence into the source drivers according to the first pulse signals; loading the black data into the source drivers according to the second pulse signals; providing a data load signal comprising a third pulse signal and a fourth pulse signal; outputting the loaded image data according to the third pulse signal using the source drivers; and outputting the loaded black data according to the fourth pulse signal using the source drivers.

According to another preferred embodiment of the invention, a driving apparatus for driving an LCD panel is provided. The driving apparatus comprises a plurality of source drivers for driving a plurality of source lines of the LCD panel, a plurality of gate drivers for driving a plurality of gate lines of the LCD panel, and a timing controller for generating a plurality of horizontal start signals, a first gate enable signal and a second gate enable signal. The horizontal start signals are respectively outputted to the source drivers; and the first and second gate enable signals correspond to different enable timings, and are selectively outputted to the gate drivers.

According to another preferred embodiment of the invention, a timing controller for controlling a plurality of source drivers and a plurality of gate drivers of an LCD panel is provided. The timing controller comprises a data processing module for generating a data signal carrying image data and black data; and a control signal generating module for generating a plurality of horizontal start signals, a first gate enable signal and a second gate enable signal. The horizontal start signals are for loading the data signal into the source drivers; and the first and second gate enable signals correspond to different enable timings, and are selectively outputted to the gate drivers.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF THE PREFERRED EMBODIMENT

To solve motion image blur in an LCD panel, embodiments of the invention provide a driving method and apparatus of an LCD panel, and an associated timing controller. The timing controller according to the invention controls source drivers and gate drivers of the LCD panel using an additionally generated control signal, to perform black strip insertion in a displayed image. Vertically scanning the displayed image using black strip insertion disturbs the sense of continuity in visual perception and weakens an effect of sample-and-hold artifact, so as to eliminate the issue of motion image blue.

Figure 1:
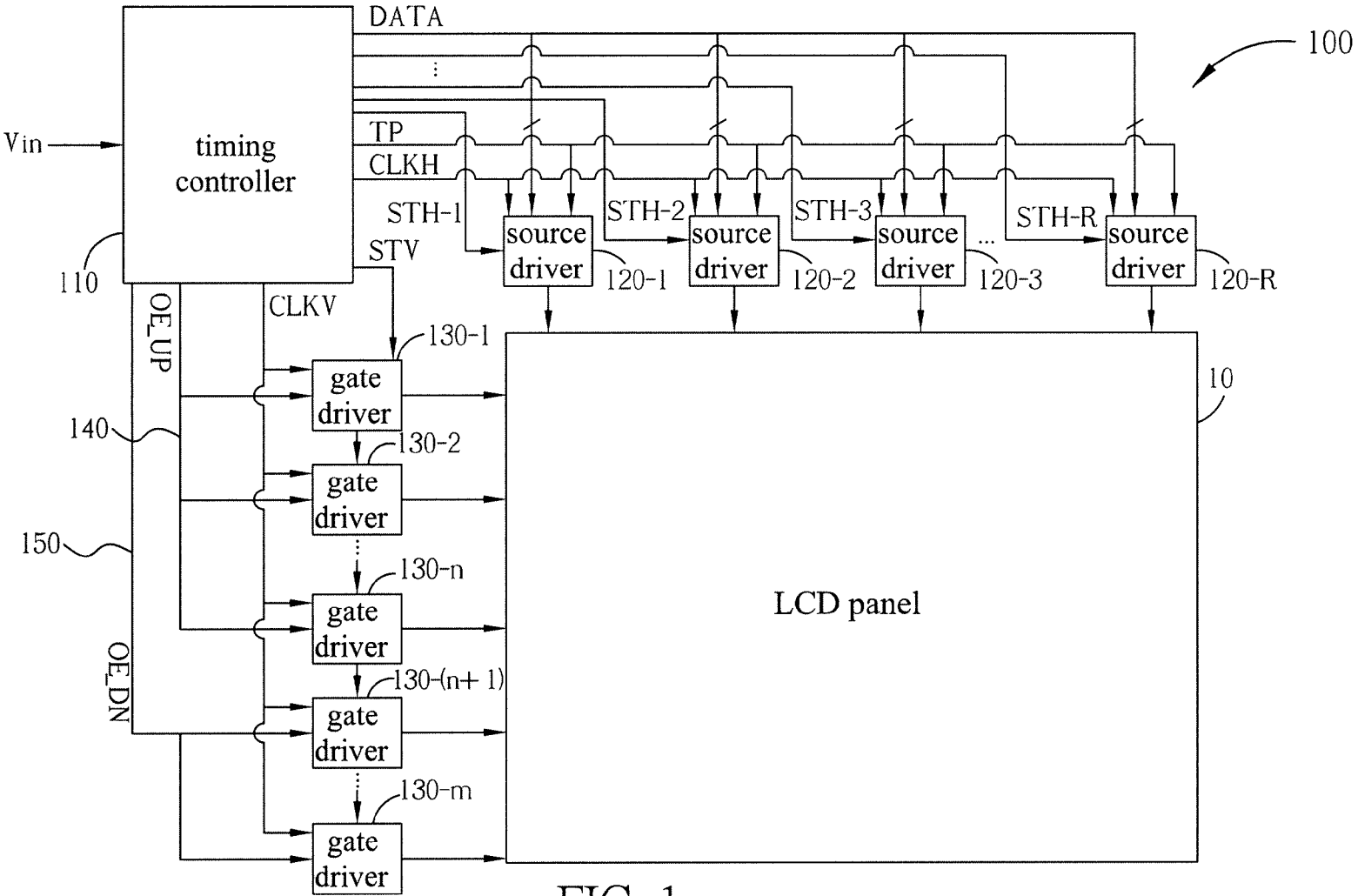
FIG. 1 is a block diagram of a driving apparatus of an LCD panel according to a first embodiment of the invention.
Figure 2:
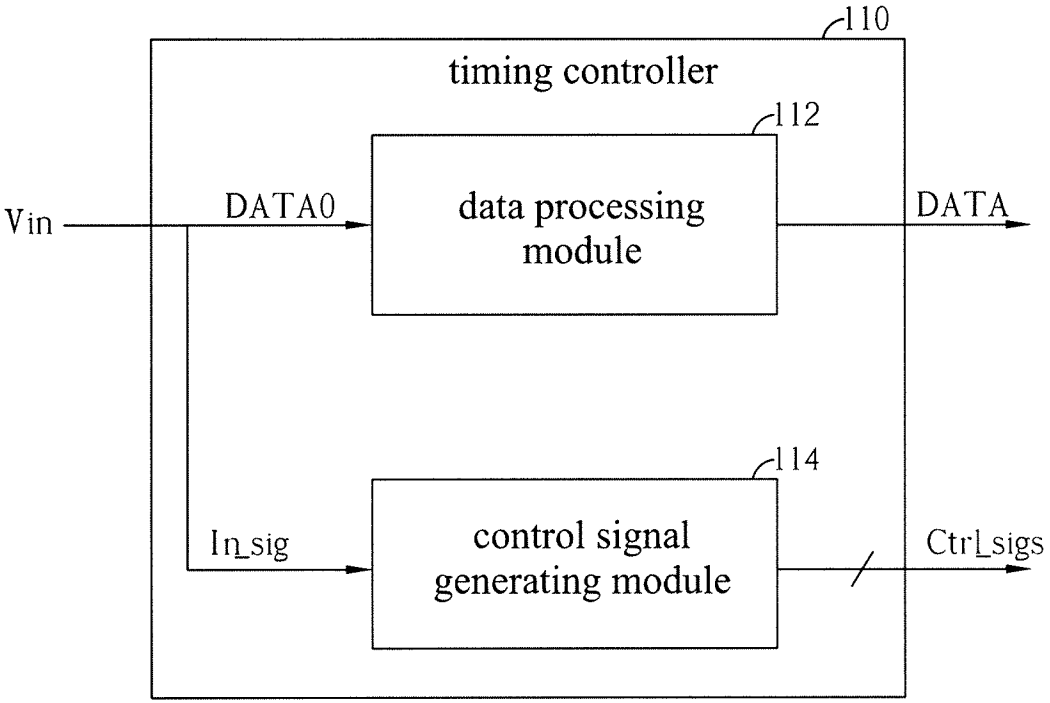
FIG. 2 is a block diagram of a timing controller according to one embodiment of the invention.

Reference is made to FIGS. 1 and 2. FIG. 1 shows a block diagram of driving apparatus 100 of an LCD panel 10 according to a first embodiment of the invention. The driving apparatus 100 comprises a timing controller 110, a plurality of source drivers 120-*r* (where r is 1, 2, 3, . . . , R), and a plurality of gate drivers 130-*s* (where s is 1, 2, . . . , n, (n+1), . . . , m). The driving apparatus 100 is for driving the LCD panel 10, and is generally disposed on the LCD panel 10 to form an LCD panel module. FIG. 2 shows a functional block diagram of the timing controller 110 in FIG. 1 according to one embodiment. The timing controller 110 comprises a data processing module 112 and a control signal generating module 114. The data processing module 112 is for inserting black data into a source data DATA0 of an input image signal Vin to output a data signal DATA. The control signal generating module 114 generates control signals Ctrl_sigs needed by the source drivers 120-*r* and the gate drivers 130-*s* according to a synchronization signal In_sig in the input image signal Vin. The control signals Ctrl_sigs include horizontal start signals STH-1~STH-R, a data load signal TP, a vertical start signal STV, and gate enable signals OE_UP and OE_DN.

According to this embodiment, the source drivers 120-*r* and the gate drivers 130-*s* drive source lines (i.e., data lines) and gate lines of the LCD panel 10, respectively. The timing controller 110 outputs the horizontal start signals STH-1~STH-R and the data load signal TP to the source drivers 120-1~120-R. The horizontal start signals STH-1~STH-R trigger the source drivers 120-1~120-R, respectively, to sequentially receive corresponding data in the data signal DATA. The data load signal TP triggers the source drivers 120-*r* to output the received data via an output end of the source drivers 120-*r*. The timing controller 110 also outputs the vertical start signal STV, and the gate enable signals OE_UP and OE_DN, to the gate drivers 130-*s*. The vertical start signal STV is transmitted via the gate driver 130-1 to the gate driver 130-*m*. The gate enable signal OE_UP controls the gate enable timing of the gate drivers 130-1~130-*n*, while the gate enable signal OE_DN controls the gate enable timing of the gate drivers 130-(*n*+1)~130-*m*. A control mechanism of controlling the source driver 120-*r* and the gate driver 130-*s* using such control signals outputted form the timing controller 110 shall be discussed below.

Figure 3:
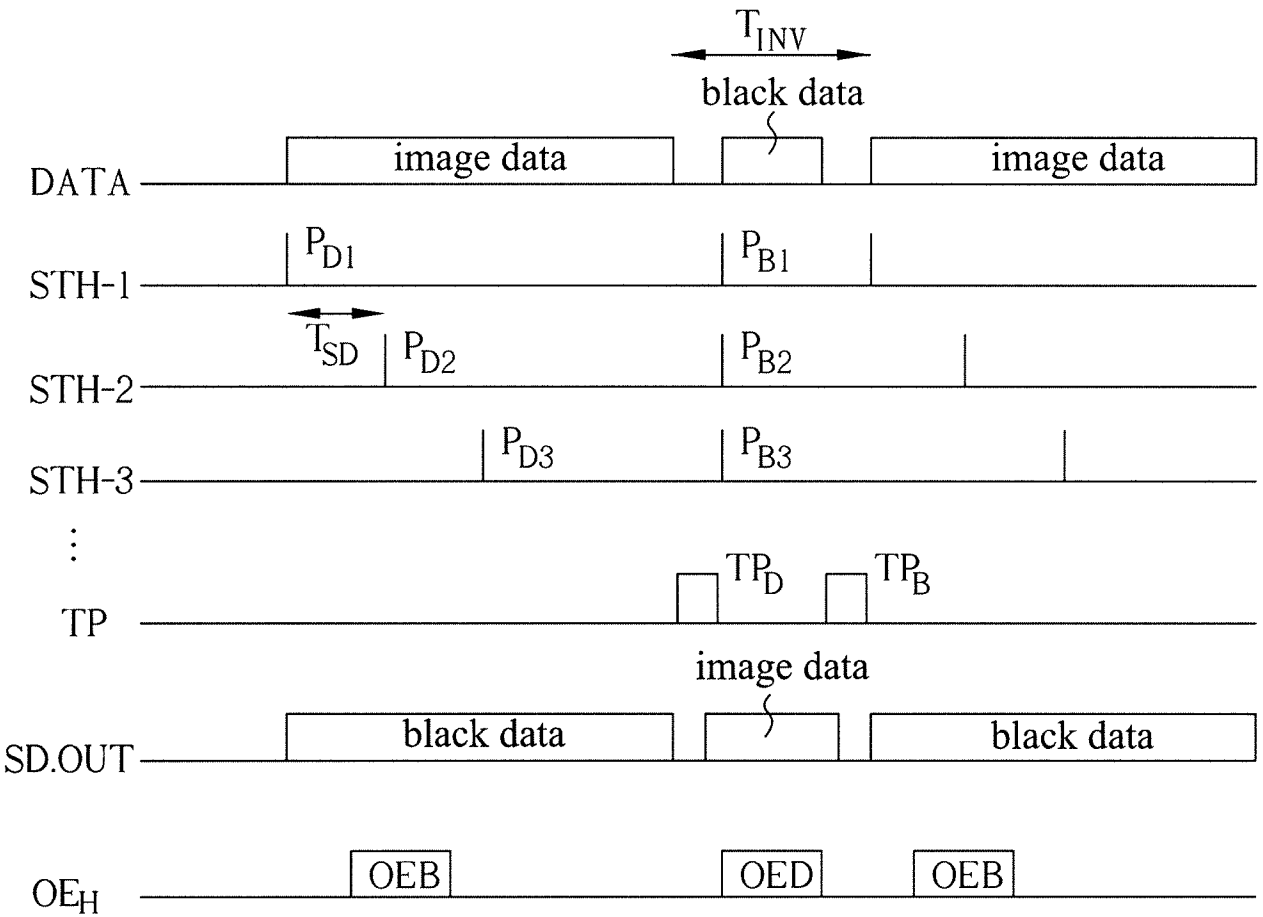
FIG. 3 is a timing diagram of signals associated with the horizontal direction in the driving method in one embodiment of the invention.
Figure 4:
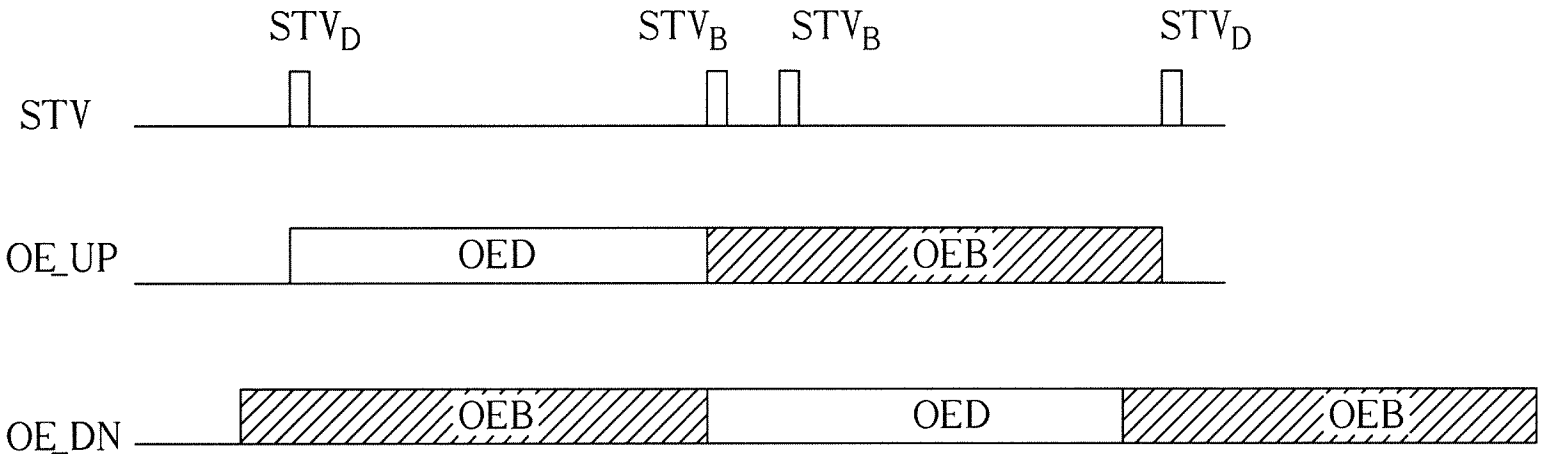
FIG. 4 is a timing diagram of signals associated with the vertical direction of the embodiment in FIG. 3.

Reference is now made to FIGS. 3 and 4. FIG. 3 shows a timing diagram of signals associated with the horizontal direction in the driving method for eliminating motion image blur according to one embodiment of the invention. FIG. 4 shows a timing diagram of signals associated with the vertical direction of the embodiment in FIG. 3. The driving method may be implemented to the driving apparatus 100 shown in FIG. 1, and more particularly, to the timing controller 110. According to this embodiment, the data processing module 112 generates a data signal DATA carrying image data and black data, as shown in FIG. 3. The data processing module 112 receives a source data DATA0 in an input image data Vin, wherein the source data DATA0 includes the image data. Further, the data processing module 12 inserts the black data between the image data of every two horizontal lines. The so-called black data here means image data that is displayed as black or nearly black on the LCD panel 10. Note that a length of the black data inserted is greater than the number of data lines driven by a single source driver, and a time interval $T_{INV}$ between the image data of the horizontal lines is greater than an operation cycle $T_{SD}$ of a single source driver to facilitate the source drivers to function normally.

The plurality of horizontal start signals STH-1, STH-2, STH-3, . . . , and STH-R generated by the control signal generating module 114 are outputted to the source drivers 120-1, 120-2, 120-3, . . . , and 120-R, respectively. Referring to FIG. 3, each horizontal start signal STH-r (where r is 1, 2, 3, . . . , and R) comprises image data horizontal start pulse $P_{Dr}$, and black data horizontal start pulse $P_{Br}$ that is absent in a conventional horizontal start signal. As shown, the horizontal start signals STH-1, STH-2, STH-3, . . . , and STH-R respectively comprise image data horizontal start pulses $P_{D1}$, $P_{D2}$, $P_{D3}$, . . . , and $P_{DR}$, and such image data horizontal start pulses sequentially appear with a time interval that equals to the operating cycle $T_{SD}$ of a single source driver. The image data horizontal start pulse $P_{Dr}$ in the horizontal start signal STH-r is for controlling the loading of the image data in the data signal corresponding to the source driver 120-*r* into the source driver 120-*r*. Since the image signal DATA provides image data corresponding the source drivers by way of streaming, and the image data horizontal start pulses $P_{D1}$, $P_{D2}$, $P_{D3}$, . . . , and $P_{DR}$ are respectively generated by the sequential image data by the timing controller 110, the image data in the data signal DATA corresponding to the source drivers 120-*r* is then inputted into the corresponding source drivers.

Figure 5:
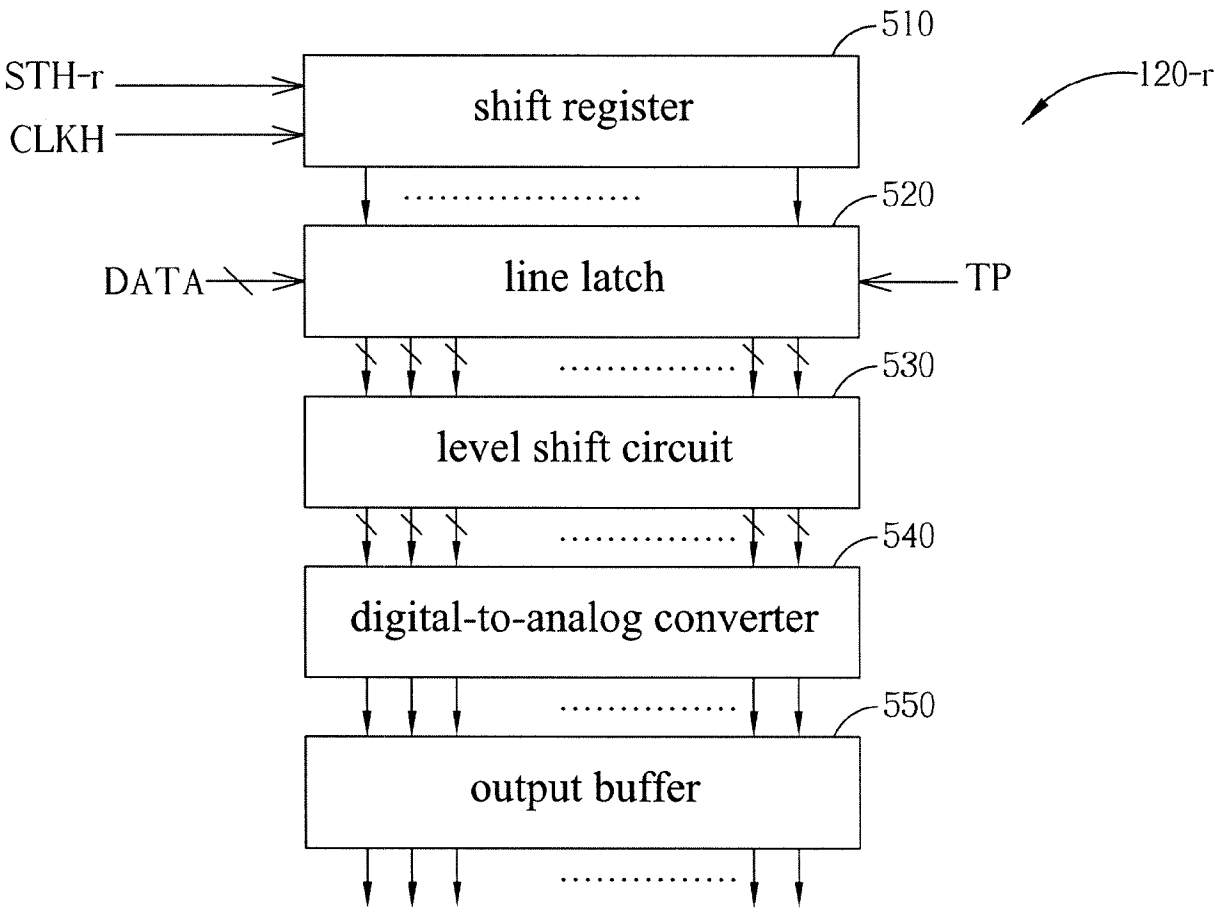
FIG. 5 is a block diagram of a conventional source driver.

FIG. 5 shows a functional block diagram of a conventional source driver. A source driver 120-*r* comprises a shift register 510, a line latch 520, a level shift circuit 530, a digital-to-analog converter (DAC) 540 and an output buffer 550. The source driver 120-*r* is a common source driver having a structure and operations that are easily appreciated by a person having ordinary skill in the art. In brief, the shift register 510 sequentially inputs the data of the data signal DATA into the line latch 520 according to the horizontal start signal STH-r and a clock signal CLKH to temporarily store the data in the line latch 520. When the line latch 520 receives a loading pulse of the data load signal TP, the data temporarily stored in the line latch 520 is then outputted via the level shift circuit 530, the DAC 540 and the output buffer 550.

The data load signal TP generated by the timing controller 110 comprises an image data loading pulse $TP_D$. When the corresponding data in the image data are loaded into the line latches 520 of the source drivers 120-*r* according to the image data horizontal start pulses $P_{D1}$, $P_{D2}$, $P_{D3}$, . . . , $P_{DR}$, respectively, the timing controller 110 controls all the source drivers 120-*r* to simultaneously output the loaded image data (i.e., the data in the line latches 520) to the LCD panel 10 by generating the image data loading pulse $TP_D$ in the image loading signal TP. During the operation of loading the image data triggered by the image data loading pulse $TP_D$, the level shift circuit 530 performs level shift and the DAC 540 performs digital-to-analog conversion, and the loaded image data is outputted via the output buffer 550 to the LCD panel 10. Referring to FIG. 3, after receiving the image data loading pulse $TP_D$, data SD.OUT outputted by the source drivers 120 is the image data, and remains unchanged until a next data loading pulse occurs. Therefore, by controlling the enable timings of the gate enable signals OE_UP and OE_DN of the gate drivers 130-*s*, the LCD panel 10 is driven by the timing controller 110 to display the image data.

Again referring to FIG. 3 and FIG. 5, the horizontal start signals STH-1, STH-2, STH-3, . . . , and STH-R further include concurrent black data horizontal start pulses $P_{B1}$, $P_{B2}$, $P_{B3}$, . . . , and $P_{BR}$. Using the black data horizontal start pulses $P_{Br}$ in the horizontal start signals STH-r, the timing controller 110 controls the source drivers 120-*r* to simultaneously load the black data in the data signal DATA into the source drivers 120-*r*. For example, when r=1, the timing controller 110 controls the line latch 520 of source driver 120-1 by using the black data horizontal start pulse $P_{B1}$ via the shift register 510 of source driver 120-1 to latch the black data. For another example, when r=R, the timing controller 110 controls the line latch 520 of source driver 120-R by using the black data horizontal start pulse $P_{BR}$ via the shift register 510 of source driver 120-R to latch the black data. Note that the data load signal TP generated by the timing controller 110 further comprises a black data loading pulse $TP_B$. After loading the black data simultaneously into the line latches 520 of each source driver 120-*r* using the black data horizontal start pulses $P_{B1}$, $P_{B2}$, $P_{B3}$, . . . , $P_{BR}$, the timing controller 110 controls the source drivers 120-*r* by using black data loading pulse $TP_B$ in the data load signal TP to output the black data, and the outputted data SD.OUT, which is the black data at this point, remains unchanged until a next data loading pulse occurs. Therefore, by controlling the enable timings of the gate enable signals OE_UP and OE_DN of the gate drivers, the LCD panel 10 is driven by the timing controller to display the black data.

As described, apart from controlling the source drivers 120-*r* to respectively load and output image data using the image data horizontal start pulses $P_{Dr}$ in the horizontal start signals STH-r and the image data loading pulse $TP_D$ in the data load signal TP, the timing controller 110 also controls the source drivers 120-*r* to respectively load and output the black data using the black data horizontal start pulses $P_{Br}$ in the horizontal start signals STH-r and the black data loading pulse $TP_B$ in the data load signal TP. It is to be noted that the data load signal TP according to this embodiment comprises both the image data loading pulse $TP_D$ and the black data loading pulse $TP_B$, wherein the black data loading pulse $TP_B$ is absent in a conventional data load signal.

Operations of the gate drivers based on the data outputted from the source drivers 120-*r* shall be described below. Referring to FIG. 3, $OE_H$ represents an enable timing of a gate enable signal, wherein OED represents a gate enable signal when the output data from the source drivers 120-*r* is the image data, while OEB represents a gate enable signal when the output data from the source drivers 120-*r* is the black data. Referring to FIG. 4, the timing controller 110 further generates a vertical start signal STV, which is to be inputted into the gate driver 130-1 and transmitted sequentially from the gate driver 130-1 to the gate driver 130-*m*. The vertical start signal STV comprises an image data vertical start pulse $STV_D$ and at least one black data vertical start pulse $STV_B$. The image data vertical start pulse $STV_D$ is for triggering the display of the image data, and the black data vertical start pulse $STV_B$ is for triggering the display of black data. The gate enable signals OED and OEB generated by the timing controller 110 are selectively outputted to the gate drivers 130-1~130-*n* via a signal line 140, or outputted to the gate drivers 130-(*n*+1)~130-*m* via a signal line 150. The gate enable signal OED is generated when the output data SD.OUT from the source drivers 120-*r* is the image data, while the gate enable signal OEB is generated when the output data SD.OUT from the source drivers 120-*r* is the black data. Note that in FIGS. 1 and 4, the gate enable signals OE_UP is a gate enable signal transmitted to the gate drivers 130-1~130-*n* via the signal line 140, whereas the enable signal OE_DN is a gate enable signal transmitted to the gate drivers 130-(*n*+1)~130-*m* via a signal wire 150. The timing controller 110 appropriately switches the gate enable signals OED and OEB to be output to the signal lines 140 and 150.

In the embodiment shown in FIG. 1, under the control of the clock signal CLKV, the image data vertical start pulse $STV_D$ of the vertical start signal STV is transmitted downwardly one row after another. When the image data vertical start pulse $STV_D$ is between the gate drivers 130-1 and 130-*n*, the timing controller outputs the gate enable signal OED to the gate drivers 130-1~130-*n* via the signal line 140. Note again that the presence of the gate enable signal OED is for when the output data SD.OUT from the source drivers 120-*r* is the image data. Therefore, in response to the downward transmission of the image data vertical start pulse $STV_D$ one row after another from the gate driver 130-1, gate lines of the LCD panel 10 are enabled one row after another as well, such that the LCD panel 10 one row after another displays the image data in the data signal DATA. However, when the image data vertical start pulse $STV_D$ is transmitted to the gate driver 130-(*n*+1), the timing controller 110 changes to output the gate enable signal OED to the gate drivers 130-(*n*+1)~130-*m* via the signal line 150. More specifically, when the image data vertical start pulse $STV_D$ is located between the gate drivers 130-(*n*+1)~130-*m*, the timing controller 110 outputs the gate enable signal OED to the gate drivers 130-(*n*+1)~130-*m* to enable one row after another gate lines of the LCD panel 10 connected to the gate drivers 130-(*n*+1)~130-*m*, such that the image data in the data signal DATA is displayed one row after another. On the other hand, when the image data vertical start pulse $STV_D$ is transmitted to the gate driver 130-(*n*+1), the timing controller 110 outputs the gate enable signal OEB to the gate drivers 130-1~130-*n* via the signal line 140 and generates at least one black data vertical start pulses $STV_B$ to be transmitted downwardly one row after another from the gate driver 130-1. Note that the presence of the gate enable signal OEB is for when the output data SD.OUT from the source drivers 120-*r* is the black data. Therefore, in response to the downward transmission of the black data vertical start pulse $STV_B$ one row after another from the gate driver 130-1, gate lines of the LCD panel 10 are enabled one row after another as well, such that the LCD panel 10 one row after another displays the black data in the data signal DATA. Similarly, when the black data vertical start pulse $STV_B$ is transmitted to the gate driver 130-(*n*+1), the timing controller 110 changes to output the gate enable signal OEB to the gate drivers 130-(*n*+1)~130-*m* via the signal line 150. More specifically, when the black data vertical start pulse $STV_B$ is located between the gate drivers 130-(*n*+1)~130-*m*, the timing controller 110 outputs the gate enable signal OEB to the gate drivers 130-(*n*+1)~130-*m* to enable one row after another gate lines of the LCD panel 10 connected to the gate drivers 130-(*n*+1)~130-*m*, such that the black data in the data signal DATA is displayed one row after another.

In the embodiment above, since one black data vertical start pulse $STV_B$ may not be able to completely turn the liquid crystals of the LCD panel 10 to an arrangement of the black data, the timing controller 110 generates at least one black data vertical start pulse $STV_B$ to ensure that the liquid crystals of the LCD panel 10 to completely turn to an arrangement of the black data, so as to display the black on the LCD panel 10.

Figure 6:
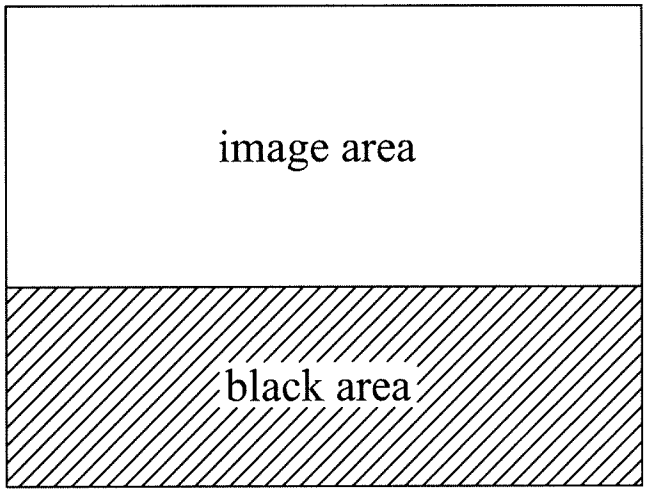
FIG. 6 is a schematic diagram of a displayed image of the LCD panel, wherein the displayed image has both image data and black data.

As described, the timing controller 110 utilizes the vertical start signals STH-1~STH-R and the data load signal TP to control the source drivers 120-1~120-R to load the image data and the black data in the data signal DATA, respectively. Further, the timing controller 110, within one frame time, generates an image vertical start pulse $STV_D$ and at least one black data vertical start pulse $STV_B$, and appropriately locates the image data vertical start pulse $STV_D$ and the black data vertical start pulse $STV_B$ at different groups of the gate drivers as well as outputting the corresponding gate enable signal to each gate driver group. For example, when the image data vertical start pulse $STV_D$ is located between the gate drivers 130-1~130*n* and the black data vertical start pulse $STV_B$ is located between the gate drivers 130-(*n*+1)~130-*m*, the timing controller 110 correspondingly outputs the gate enable signal OED to the gate drivers 130-1~130-*n* and the gate enable signal OEB to the gate drivers 130-(*n*+1)~130-*m*. On the contrary, when the image data vertical start pulse $STV_D$ is located between the gate drivers 130-(*n*+1)~130-*m* and the black data vertical start pulse $STV_B$ is located between the gate drivers 130-1~130-*n*, the timing controller 110 correspondingly outputs the gate enable signal OED to the gate drivers 130-(*n*+1)~130-*m* and the gate enable signal OEB to the gate drivers 130-1~130-*n*. Therefore, the image displayed according to the image data vertical start pulse $STV_D$ and the gate enable signal OED by the LCD panel 10 is replaced by a black image using the black data vertical start pulse $STV_B$ and the gate enable signal OEB, such that the LCD panel 10 displays an image consisted of both an image area and a black area, as in FIG. 6 showing a schematic diagram of an image displayed by the LCD panel 10. Thus, the timing controller 110 controls the LCD panel to cyclically display a black strip (i.e., the black area) throughout the entire image displayed. Therefore, by implementing the foregoing insertion mechanism of the black strip capable of disturbing the sense of continuity in visual perception that is closely related to sample-and-hold artifact, the present invention eliminates motion image blur resulting from such sample-and-hold artifact.

Figure 7:
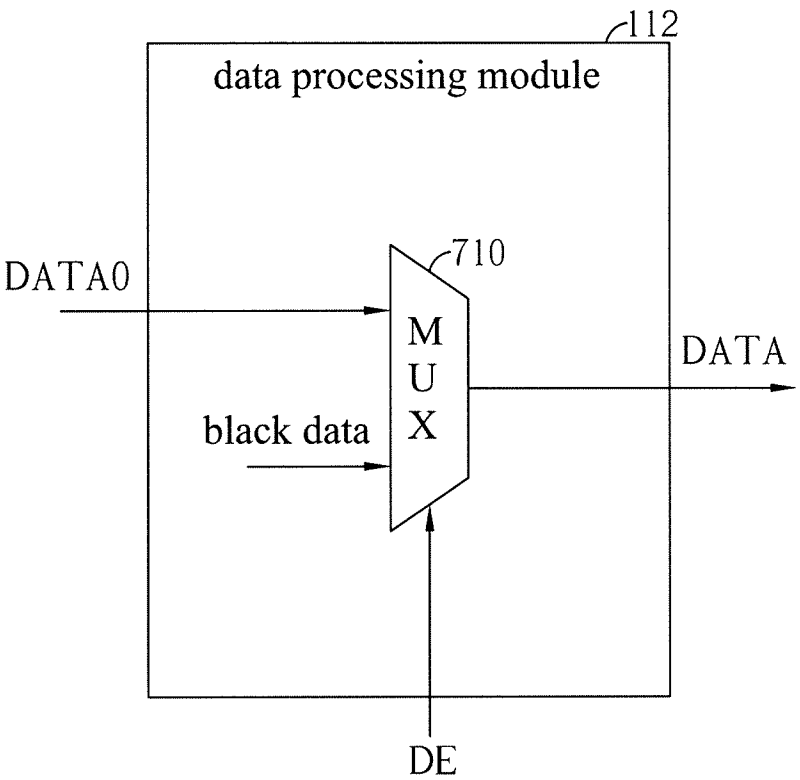
FIG. 7 is a schematic diagram of the data processing module in FIG. 2 according to one embodiment.

Reference is now made to FIG. 7, which shows a schematic diagram of a data processing module in FIG. 2 according to one embodiment of the invention. The data processing module 112 comprises a multiplexer 710, which has two input ends for respectively receiving the source signal DATA0 in the input image signal Vin and the black data. The black data is preferably stored in advance in a register (not shown) of the timing controller 110. A data enable signal DE in the input image signal Vin serves as a control signal for the multiplexer 710. When the data enable signal DE is at logic high, the multiplexer 710 selects to output the source signal DATA0; whereas when the data enable signal DE is at logic low, the multiplexer 710 selects to output the black data. Since the source signal DATA0 is serial data and only carries the image data when the data enable signal DE is at logic high, the signal data DATA outputted from the output end of the multiplexer 710 is the source signal DATA0 inserted with the black data between the image data of every two horizontal lines; that is, the black data is inserted into the horizontal blanking interval of the source signal DATA0.

Figure 8:
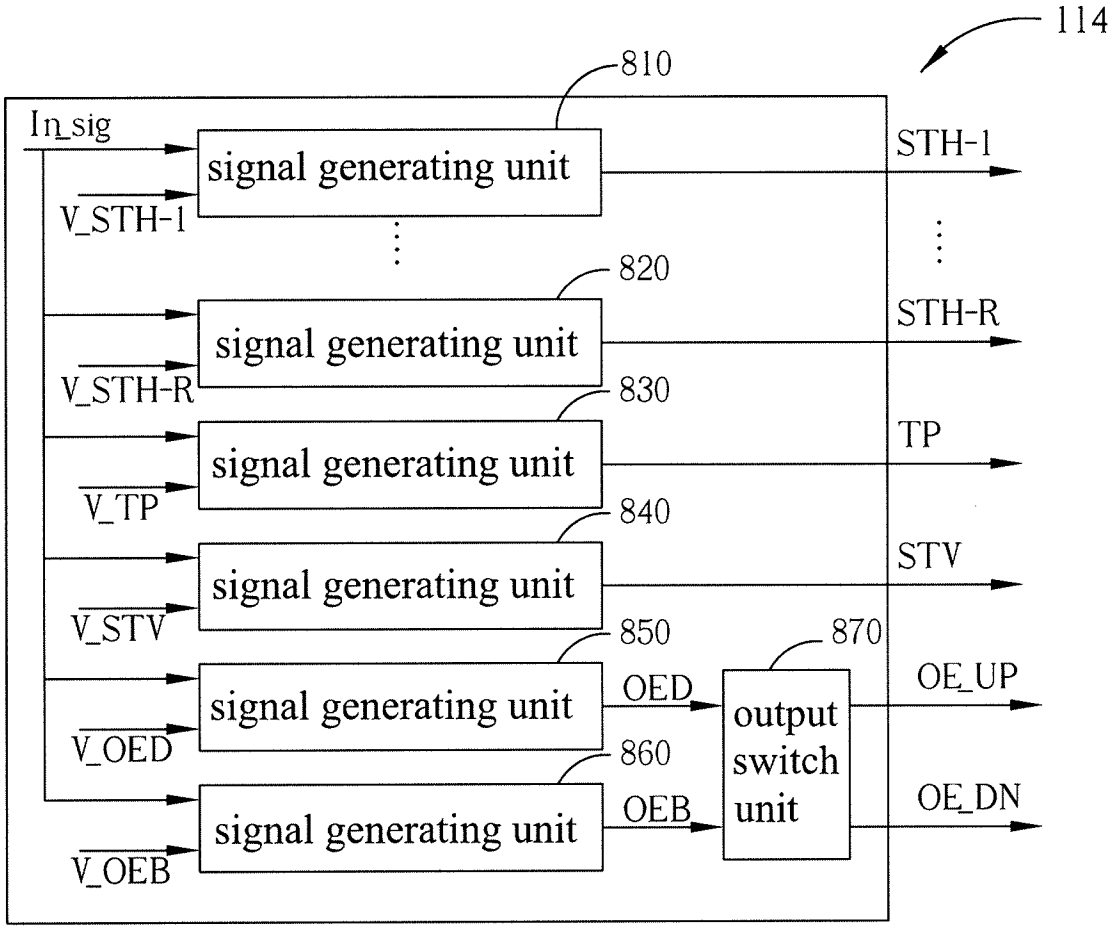
FIG. 8 is a block diagram of the control signal generating module in FIG. 2 according to one embodiment.
Figure 9:
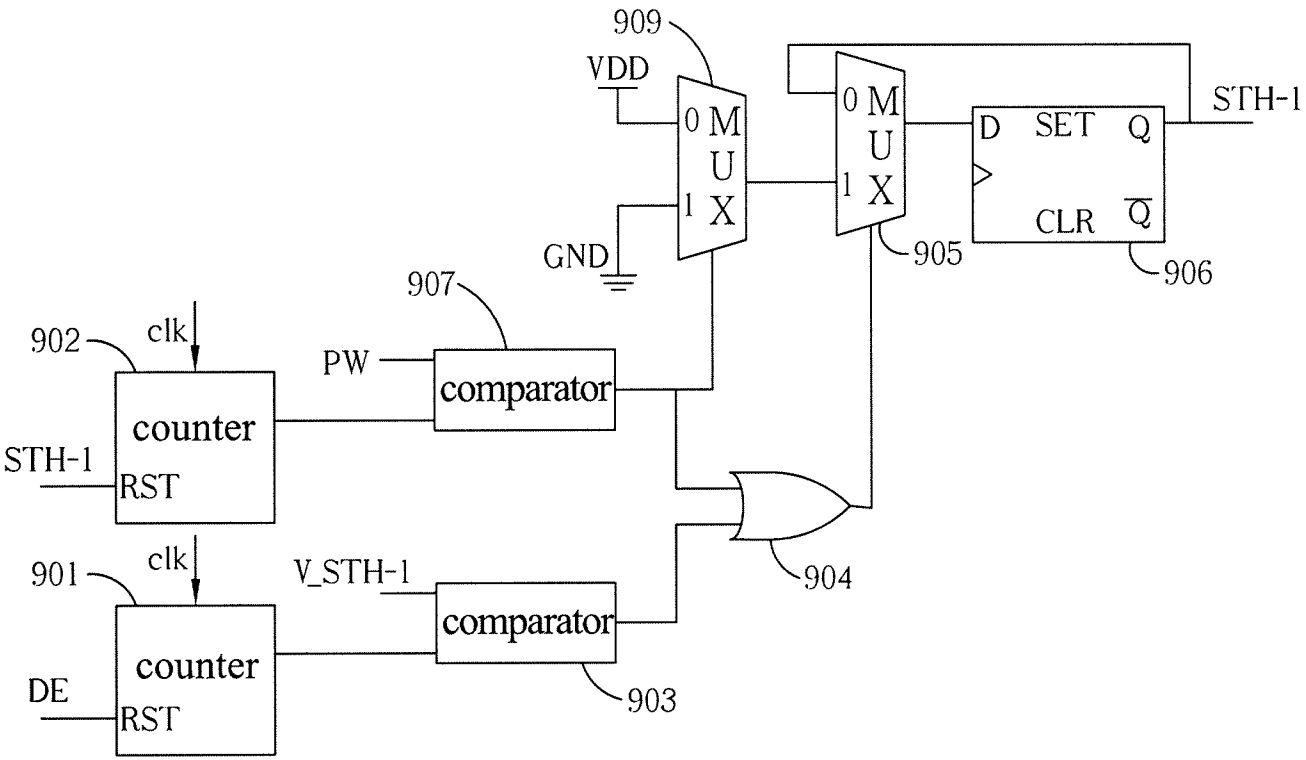
FIG. 9 is a schematic diagram of the control signal generating unit 810 in FIG. 8.

FIG. 8 shows a block diagram of the control signal generating module in FIG. 2 according to one embodiment of the invention. As shown, the control signal generating module 114 comprises a plurality of signal generating units 810~860. Each control signal generating unit generates a control signal for the source driver 120-*r* or the gate driver 130-*s* according to the synchronization signal In_sig in the input image signal Vin and a setting value. For example, the control signal generating unit 810 generates the horizontal start signal STH-1 according to a setting value V_STH-1 and the data enable signal DE in the synchronization signal In_sig. Referring to FIG. 9 showing a schematic diagram of the control generating unit 810 in FIG. 8 according to one embodiment, the control signal generating unit 810 comprises counters 901 and 902, comparators 903 and 907, an OR gate 904, multiplexers 905 and 909, and a D-type flip-flop 909. The data enable signal DE is inputted into a reset end RST of the counter 901. When the counter 901 encounters the rising edge of the data enable signal DE, its counter value is reset. The comparator 903 keeps comparing the counter value received from the counter 901 with the setting value V_STH-1. When the counter value of the counter 901 equals to the setting value V_STH-1, the comparator 903 outputs a logic signal "1" to the OR gate 904, which then outputs a logic signal "1" to a control end of the multiplexer 905. Upon receiving the logic signal "1", the multiplexer 905 outputs a signal received at an input end corresponding to the logic signal "1", that is, the input end corresponding to the logic signal "1" of the multiplexer 905 receives output data from the multiplexer 909. At this point, a control signal received at a control end of the multiplexer 909 is a logic signal "0", and the multiplexer 909 then outputs a signal (i.e., VDD at logic high) received at an input end corresponding to the logic signal "0" to the multiplexer 905. Accordingly, the high-logic VDD from the multiplexer 905 is outputted to an input end of the D-type flip-flop 906 to pull high the horizontal start signal STH-1 from an output end of the D-type flip-flop 906 to logic-high VDD. Meanwhile, the horizontal start signal STH-1 resets the counter 902, and the comparator 907 compares a counter value of the counter 907 with a pulse width PW. When the counter value of the counter 907 equals the pulse width PW, the comparator 907 outputs a logic signal "1" to a control end of the multiplexer 909, so as to switch the multiplexer 909 to output a signal (i.e., logic-low GND) received at the input end corresponding to the logic signal "1" and pull down the horizontal start signal STH-1 from an output end of the D-type flip-flop 906 to the low-logic GND. The value of the pulse width PW is a pulse width of the horizontal start signal STH-1. In general, the pulse width of the horizontal start signal is one clock cycle. The control signal generating unit 810 shown in FIG. 8 is used in FIG. 9 for illustrative purposes, and the control signal generating units 820~860 in FIG. 8 may also be realized similarly as using the control signal generating unit 810 in FIG. 9. In one embodiment, setting values V_STH-1~V_STH-R, V_TP, V_STV, V_OED and V_OEB used by the control signal generating module 114 may be stored in advance in a register (not shown) of the timing controller 110.

Figure 10:
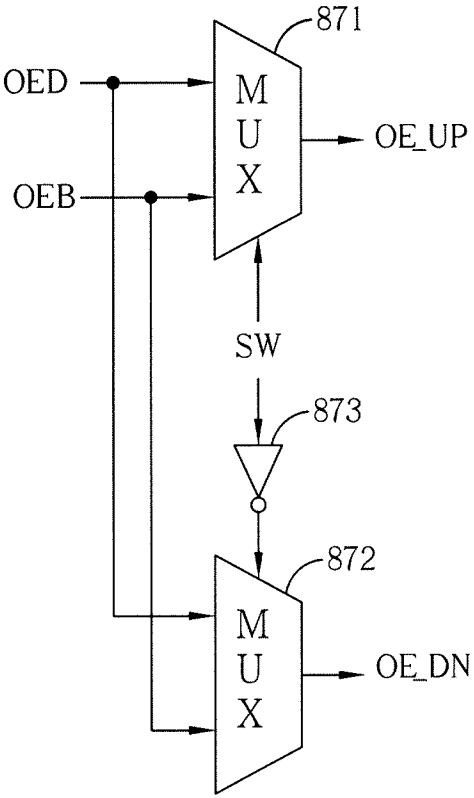
FIG. 10 is a schematic diagram of the output switch unit 870 in FIG. 8.

Referring to FIG. 8, the gate enable signal OED generated by the control signal generating unit 850 and the gate enable signal OEB generating by the control signal generating unit 860 are outputted via an output switch unit 870 as the gate enable signal OE_UP and the gate enable signal OE_DN, respectively. The gate enable signal OE_UP is outputted to the signal line 140, and the gate enable signal OE_DN is outputted to the signal line 150. FIG. 10 shows a schematic diagram of the output switch unit 870 in FIG. 8. The output switch unit 870 comprises multiplexers 871 and 872, and an inverter 873. The gate enable signal OED and the gate enable signal OEB are inputted into the multiplexers 871 and 872, and a switch control signal SW is directly inputted into a control end of the multiplexer 871 and inputted to a control end of the multiplexer 872 via the inverter 873. The switch control signal SW is for appropriately switching the output of the multiplexers 871 and 872. In one embodiment, the switch control signal SW is generated according to the synchronization signal In_sig in the input image signal Vin.

Figure 11:
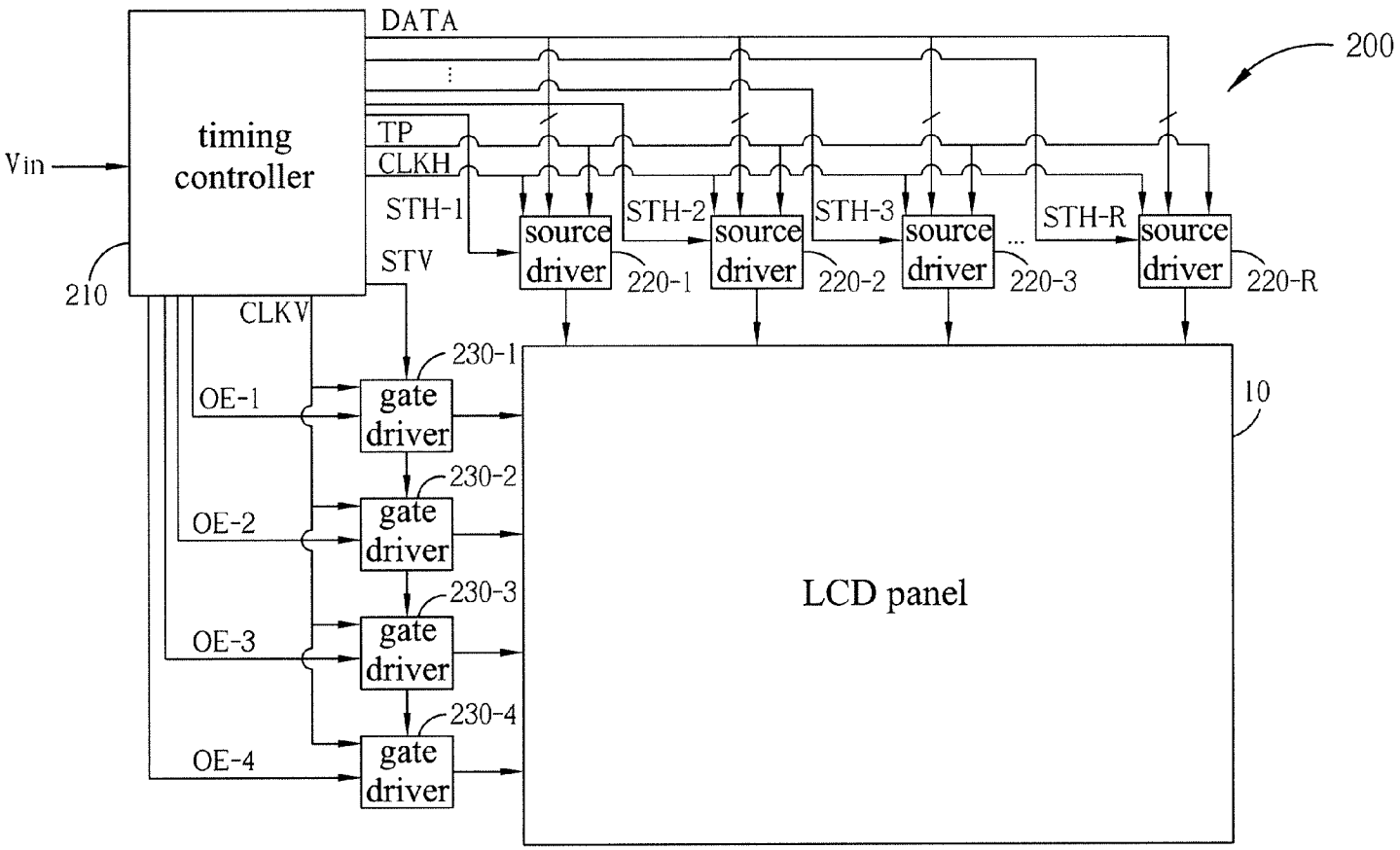
FIG. 11 is a block diagram of a driving apparatus of an LCD panel according to a second embodiment of the invention.
Figure 12:
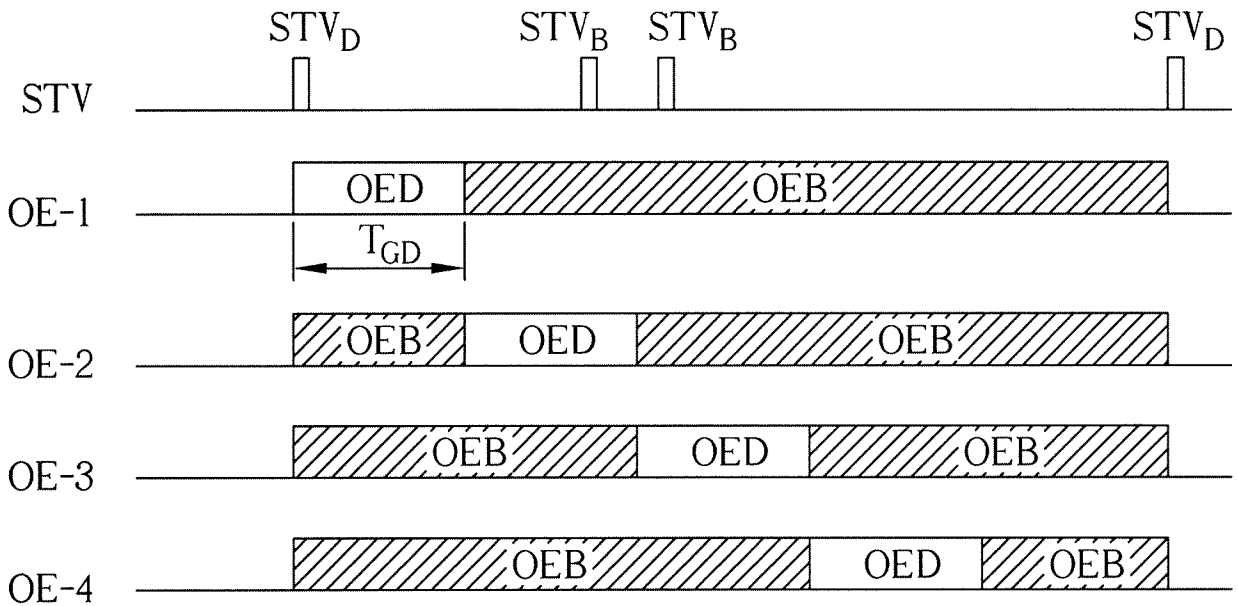
FIG. 12 is a timing diagram of signals associated with the vertical direction in the embodiment shown in FIG. 11.

FIG. 11 shows a block diagram of a driving apparatus of an LCD panel according to a second embodiment of the invention, which is a modification from the first embodiment. In the second embodiment, a timing controller 210 respectively outputs gate enable signals OE-1~OE-4 to gate drivers 230-1~230-4. FIG. 12 shows a timing diagram of signals associated with the vertical direction in the first embodiment. Note that in FIG. 12, $T_{GD}$ represents an operating cycle of a single gate driver, and the timing controller 210 switches the gate enable signals OE-1~OE-4 between the gate enable signal OED corresponding to the presence of the image data and the gate enable signal OEB corresponding to the presence of the black data using the operating cycle $T_{GD}$ of the gate driver as a time unit. For example, when the gate enable signal OE-1 is the gate enable signal OED, the gate enable signals OE2~OE4 are the gate enable signal OEB. After one operating cycle $T_{GD}$, the gate enable signal OE-1 is switched to the gate enable signal OEB, the gate enable signal OE-2 is switched to the gate enable signal OED, and the gate enable signals OE3~OE4 remain unchanged. In the second embodiment, principles other than how the timing controller 210 generates the gate enable signals to the gate drivers are the same as those in the first embodiment, and shall not be described for brevity.

Therefore, compared with the prior art, the driving method and apparatus, and the associated timing controller, by controlling timing of drivers of an LCD panel inserting black strips, effectively eliminate motion image blur and more particularly sample-and-hold artifact without making changes to the standardized off-the-shelf drivers.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A driving method for driving an LCD panel with a driving apparatus comprising a plurality of source drivers, the driving method comprising: providing a data signal for carrying image data and black data; providing a plurality of horizontal start signals from a timing controller to each of said plurality of source drivers respectively, wherein each of horizontal start signals having a first pulse signal and a second pulse signal; sequentially loading the image data into the source drivers according to the first pulse signals; sequentially loading the black data into the source drivers according to the second pulse signals; providing a data load signal comprising a third pulse signal and a fourth pulse signal; outputting the loaded image data by the source drivers according to the third pulse signal; and outputting the loaded black data by the source drivers according to the fourth pulse signal.

2. The driving method as claimed in claim 1, wherein the loaded image data is outputted when all the image data is loaded into the source drivers according to the first pulse signals.

3. The driving method as claimed in claim 1, wherein the loaded black data is outputted when all the black data is loaded into the source drivers according to the second pulse signals.

4. The driving method as claimed in claim 1, wherein the second pulse signals trigger the black data to be simultaneously loaded into the source drivers.

5. The driving method as claimed in claim 1, the driving apparatus further comprising a plurality of gate drivers, the driving method further comprising:

providing a first gate enable signal and a second gate enable signal; wherein the first gate enable signal corresponds to when output data of the source drivers is the image data, and the second gate enable signal corresponds to when the output data of the source drivers is the black data; and controlling the gate drivers by selecting either the first enable signal or the second gate enable signal.

6. The driving method as claimed in claim 5, further comprising:

providing two vertical start signals that sequentially pass through the gate drivers within a frame time.

7. A driving apparatus for driving an LCD panel, comprising:

a plurality of source drivers, for driving a plurality of source lines of the LCD panel;

a plurality of gate drivers, for driving a plurality of gate lines of the LCD panel; and a timing controller, for generating a plurality of horizontal start signals, a first gate enable signal and a second gate enable signal;

wherein, the horizontal start signals are respectively outputted to the source drivers, and the first gate enable signal and the second gate enable signal correspond to different enable timings and are selectively outputted to the gate drivers.

8. The driving apparatus as claimed in claim 7, wherein the timing controller further generates a data signal carrying image data and black data according to an input image signal.

9. The driving apparatus as claimed in claim 8, wherein each of the horizontal start signals comprises a first pulse signal and a second pulse signal, wherein first pulse signals are for loading the image data in sequence to the source drivers, and second pulse signals are for loading the black data to the source drivers.

10. The driving apparatus as claimed in claim 9, wherein the timing controller further generates a data load signal comprising a third pulse signal and a fourth pulse signal, the third pulse signal is for triggering the source drivers to output the image data, and the fourth pulse signal is for triggering the source drivers to output the black data.

11. The driving apparatus as claimed in claim 10, wherein the first gate enable signal corresponds to when output data from the source drivers is the image data, and the second gate enable signal corresponds to when the output data from the source drivers is the black data.

12. The driving apparatus as claimed in claim 7, wherein the timing controller outputs two vertical start signals to the gate drivers within a frame time.

13. A timing controller, for controlling a plurality of source drivers and a plurality of gate drivers to drive an LCD panel, comprising:

a data processing module, for generating a data signal carrying image data and black data; and a control signal generating module, for generating a plurality of horizontal start signals, a first gate enable signal and a second gate enable signal;

wherein the horizontal start signals load data of the data signal to the source drivers respectively, and the first gate enable signal and the second gate enable signal correspond to different enable timings and are selectively outputted to the gate drivers.

14. The timing controller as claimed in claim 13, wherein each of the horizontal start signals comprises a first pulse signal and a second pulse signal, wherein first pulse signals are for loading the image data in sequence to the source drivers, and second pulse signals are for loading the black data to the source drivers.

15. The timing controller as claimed in claim 14, wherein the control signal generating module further generates a data load signal comprising a third pulse signal and a fourth pulse signal, the third pulse signal is for triggering the source drivers to output the image data, and the fourth pulse signal is for triggering the source drivers to output the black data.

16. The timing controller as claimed in claim 15, wherein the first gate enable signal correspond to when output data from the source drivers is the image data, and the second gate enable signal corresponds to when the output data from the source drivers is the black data.

17. The timing controller as claimed in claim 16, wherein the control signal generating module further generates two vertical start signals to the gate drivers within one frame time.

18. The timing controller as claimed in claim 13, wherein the control signal generating module generates the horizontal start signals, the first gate enable signal and the second gate enable signal according to a synchronization signal in an input image signal.

19. The timing controller as claimed in claim 18, wherein the control signal generating module comprises a plurality of control signal generating units, which respectively generate the horizontal start signals, the first gate enable signal and the second gate enable signal according to the synchronization signal and a plurality of setting values.

20. The timing controller as claimed in claim 13, wherein the data processing module generates the data signal by inserting the black data into a horizontal blanking interval of an input image signal.

* * * * *